US006895863B2

(12) United States Patent
Hatzl et al.

(10) Patent No.: US 6,895,863 B2
(45) Date of Patent: May 24, 2005

(54) METHOD OF MAKING PYROTECHNIC INITIATOR WITH IGNITION BRIDGE

(75) Inventors: Robert Hatzl, Eggendorf/Siedlung Maria Theresia (AT); Kurt Aigner, Vienna (AT)

(73) Assignee: Hirtenberger Automotive Safety GmbH, Hirtenberg (AT)

( * ) Notice: Subject to any disclaimer, the term of this patent is extended or adjusted under 35 U.S.C. 154(b) by 0 days.

(21) Appl. No.: 10/737,628

(22) Filed: Dec. 16, 2003

(65) Prior Publication Data

US 2004/0123764 A1 Jul. 1, 2004

Related U.S. Application Data

(62) Division of application No. 10/081,884, filed on Feb. 21, 2002.

(30) Foreign Application Priority Data

Feb. 23, 2001 (AT) ..... A 296/2001

(51) Int. Cl.[7] ..... F42B 3/18
(52) U.S. Cl. ..... 102/202.5
(58) Field of Search ..... 102/202.5, 202.9, 102/202.7, 202.11

(56) References Cited

U.S. PATENT DOCUMENTS 4,729,315 A * 3/1988 Proffit et al. ..... 102/202.9
6,272,965 B1 * 8/2001 Baginski et al. ..... 86/1.1
2003/0192445 A1 * 10/2003 Baginski et al. ..... 102/202.5

* cited by examiner

*Primary Examiner*—Teri Pham Luu
*Assistant Examiner*—Susan C. Alimenti
(74) *Attorney, Agent, or Firm*—Herbert Dubno

(57) ABSTRACT

A pyrotechnic initiator, for example, for inflatable safety air bags of automotive vehicles can include an electrically energizable initiator bridge and a reactive layer on the initiator bridge for liberation of energy upon electrical energization of the bridge. The reactive layer can consist of a combustible metal or a metal capable of liberating energy by alloying with a metal of the bridge.

7 Claims, 1 Drawing Sheet

METHOD OF MAKING PYROTECHNIC INITIATOR WITH IGNITION BRIDGE

CROSS REFERENCE TO RELATED APPLICATION

This application is a division of Ser. No. 10/081,884 filed Feb. 21, 2002.

FIELD OF THE INVENTION

Our present invention relates to a pyrotechnic initiator with an ignition bridge to which a reactive layer is applied.

BACKGROUND OF THE INVENTION

A pyrotechnic initiator or ignitor, for example, for activating an air bag inflator, is described in the European patent document EP 609 605 A1. In FIG. 4 of that publication an ignition bridge has been illustrated to which a pyrotechnic material is applied by a printing process or by painting. The pyrotechnic material is designed to react with a release of sufficient energy to cause an air bag to expand. The pyrotechnic material specifically named in this publication is lead styphnate.

The advantage of the use of a pyrotechnic material on an igniting bridge is that the energy released is greater than the electrical energy supplied. With the aid of this additional energy, a space between the bridge and the ignited material can be jumped with ease.

It is, however, a disadvantage that such an organic material, as has been provided in EP 609 605 A1, is not mechanically and thermically stable under a variety of circumstances and the contact between the printed layer and the ignition bridge cannot always be reliably ensured.

OBJECTS OF THE INVENTION

It is, therefore, the principal object of the present invention to overcome the aforementioned drawbacks and provide an improved pyrotechnic initiator which is free from them.

Another object of this invention is to provide an improved pyrotechnic initiator which is less sensitive to thermal instability of the pyrotechnic material and which can ensure that any pyrotechnic material which is provided is more mechanically and thermally stable than has hitherto been the case.

Still another object of the invention is to provide an improved pyrotechnic initiator for the purposes described whereby the contact between any applied reactive material and the ignition bridge can be reliably assured over the long term.

SUMMARY OF THE INVENTION

These objects are achieved, in accordance with the invention by providing a pyrotechnic initiator which comprises an electrically energizable initiator bridge and a reactive layer on the initiator bridge for liberation of energy upon electrical energization of the bridge. According to the present invention, the reactive layer is comprised of a combustible metal or a metal capable of liberating energy by alloying with a metal of the bridge. In a system in which the reactive layer consists substantially of a combustible metal or a metal which alloys with the metal of the initiator bridge to release energy, problems with respect to the organic reactive material previously used can be completely avoided.

The initiator bridge can be constructed in the manner described in Austrian patent document AT 405 591 B.

According to the invention, a metal serves as the reactive material and no organic compound need be applied to the initiator bridge, thereby ensuring a higher mechanical stability. It is possible to use, as the reactive metal, a metal which reacts with oxygen and liberates energy in this manner. It is however also possible to provide a metal as the reactive material which reacts with the metal of the initiator bridge itself. In that case, when the initiator bridge is heated up, the initiator bridge metal itself melts and forms with the reactive metal an alloy. The heating can be sufficient to melt the reactive metal itself and allow the alloy which is formed exothermically to result from a dissolution of the metal of the initiator bridge in the reactive metal. In any case, the reactive metal which is chosen should be capable of liberating sufficient energy to bridge the gap with any material which must be ignited by the pyrotechnic initiator of the air bag.

Preferably the reactive layer is applied as a streak or stripe to the initiator bridge or is in the form of islets as applied to the bridge. This provides significant advantages both with respect to the application process and the cost. In principle, however, it is also possible to apply the layer as a laminate to the bridge.

Initiator bridges of the type with which the invention are concerned are usually trimmed by means of a laser, i.e. are reduced in width so that the electrical resistance of the bridge has a precisely predetermined value. When the reactive layer is applied in the form of a streak or as islets, one can readily trim a region which is free from the reactive layers by laser, thereby simplifying the trimming process.

Preferably a thin electrically insulating layer is provided between the initiator bridge and the reactive layer. This electrically insulating layer can be composed of an oxide or nitride of the metal of the reactive layer. The electrically insulating layer prevents the reactive layer from modifying the electrical resistance of the initiator bridge. The electrically insulating layer must, naturally, be sufficiently thin that its thermal resistance is negligibly small and thus does not materially interfere with the activation of the reactive metal. It is preferable to use zirconium as a combustible metal forming the reactive layer.

The ignition amplifying effect then is a result of the fact that the metallic zirconium, upon being brought to a temperature above its ignition temperature by the suitable supply of electrical energy to the initiator bridge, burns in air with a high release of energy, i.e. highly exothermically. Instead of zirconium, titanium, hafnium, niobium, tantalum, aluminum or nickel can be used.

It is especially preferable that the metal of the initiator bridge be composed entirely or substantially of gold and/or palladium. In that case, the combustible metal may be nickel and optionally an ignition amplifier or promoter can be used in the region of the bridge and the reactive layer.

The deposition of a nickel layer on a gold or palladium base metal is electrochemically advantageous and has been utilized in other applications. It can be utilized to apply the nickel to the initiator bridge in accordance with the invention as well and any conventional process including currentless methods for the deposition of nickel layer on gold or palladium can be used.

Utilizing the dispersion electrolysis method, a variety of metal powders, for example, one of the ignition promoting metals, like zirconium, hafnium, tantalum or niobium, can be deposited with the nickel. Preferably the particle size of the metal powder in the dispersion is about one $\mu$m. A special advantage of the gold/nickel combination is that the two metals are practically nonmiscible up to about 200° C., thereby ensuring a long useful life of the gold/nickel system for the purposes of the present invention.

To produce a pyrotechnic initiator with a bond between the ignition bridge and the combustible metal, the method of the invention provides that initially a synthetic resin in which the reactive metal is dispersed is printed (e.g. by screen printing) on the base metal of the bridge, the resin is permitted to dry, the metal is then sintered and in the sintering process forms a bond with the base metal. The applied metal can be present in the resin as the elemental metal or an alloy thereof or as a metal compound (for example a resinate in the resin). The printing can be effected inexpensively by screen printing. By a corresponding choice of atmosphere during sintering it is possible to form a layer of the oxide or nitride of the combustible layer to provide the electrical insulation described previously to the latter, the ignition promoting layer can be applied. The combination of screen printing and sintering can ensure the requisite thermal contact between the initiator bridge and the combustible metal in all cases.

This mode of application is not, however, the only approach which can be used. For a non-noble metal, it is possible to utilize vapor deposition or sputtering.

According to another preferred embodiment of the invention, the metal in the initiator bridge consist substantially of platinum or a platinum group metal and the reactive metal consists of aluminum. In this case, another metal is applied to an initiator bridge which can alloy with a significant energy release. The initiator bridge is comprised of a noble metal and the non-noble metal can be applied over the noble metal or under the noble metal. The system can have a long life (15 years or more).

To produce such an initiator bridge, the invention can utilize either of the two methods described below:

One can initially apply the non-noble metal in the form of a resin by screen printing to a support and then sinter it in a reducing atmosphere, whereupon the noble metal is applied in an electrochemical process or by vapor deposition or by sputtering.

Alternatively, the nobler metal can be applied in the form of a suspension in resin by screen printing and then sintered. Afterward the less noble metal can be printed in a resin or binder onto the nobler metal from a dispersion in which the less noble metal is in its elemental metallic form or as a metal compound in the resin. The latter layer is then sintered at a reduced temperature in a protective gas (e.g. argon) to the metallic state.

The carrier element or the support can be composed of a ceramic (Steatite, alumina, zirconia). A thermally insulating layer is thereby formed. The carrier element can however also be comprised of steel. In this case an electrically and therminally insulating layer can be provided to separate the bridge from the steel support. This approach is analogous to the known metal board technology.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
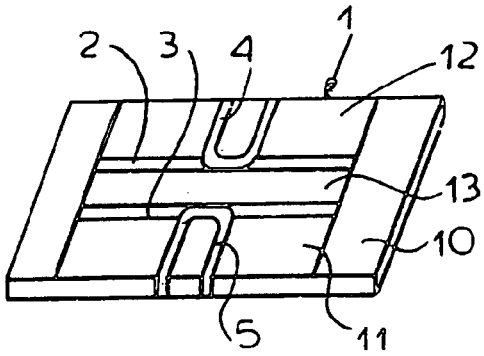
FIG.1 PRIOR ART
FIG. 1 is a perspective view showing a prior art arrangement of an initiator bridge or a safety air bag or an automotive vehicle.

In the drawing initiator bridges have been shown in highly diagrammatic form. The contact pads which permit the bridges to be connected in the electrical initiator circuit have not been illustrated and are conventional in the art.

As can be seen from FIG. 1, the initiator bridge 1, which is of the laser trimmed type, comprises a ceramic support 10, e.g. of alumina, having two parallel lines trimmed in the conductive layer by a laser, thereby separating two outer strips 11 and 12 from a relatively thin intermediate strip 13. The two outer strips are further interrupted by additional u-shaped cuts 4 and 5 so that only the thin intermediate strip remains conducting. This strip has such a relatively high resistance that it is rapidly heated to a high temperature by a current flow so as to ignite the pyrotechnic material of the safety air bags.

Figure 2:
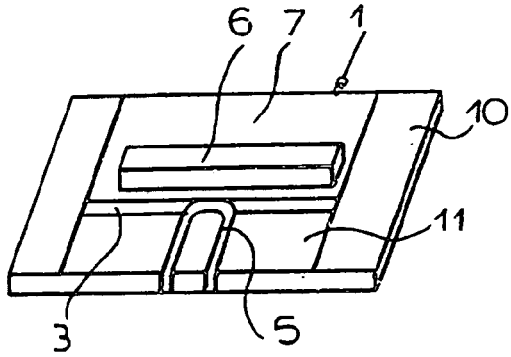
FIG. 2 is a perspective view of a first embodiment of an initiator bridge according to the invention.

As can be seen from FIG. 2, in the system of the invention, a reactive metal 6 can be applied to a base metal 7 of the ignitor bridge. The metal 6 can be zirconium and the metal 7 can be a gold/palladium alloy. The metal 6 is shown to be applied in the form of a streak or strip so that the trimming of the metal strip 11 on the support 10 by the unshaped cut 5 is not interfered with. In FIG. 2, only a single line 3 and a single u-shaped cut 5 have been used.

In this embodiment, the heating of the bridge causes ignition of the zirconium and thereby promotes the firing of the inflator for a safety air bag.

Figure 3:
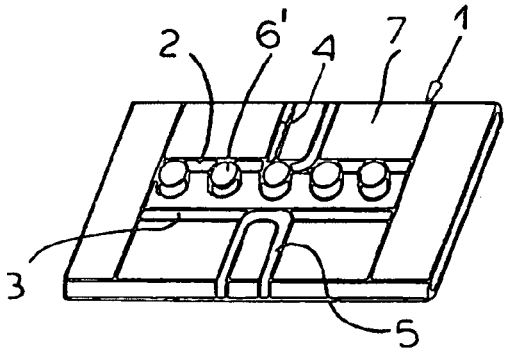
FIG. 3 is a second embodiment of an initiator bridge according to the invention.

In the embodiment of FIG. 3 the metal 6' is provided in the form of a multiplicity of islets on the metal 7. In this embodiment as well, the cuts 4 and 5 as well as the cuts 2 and 3 can be fabricated by laser trimming without difficulty.

Figure 4:
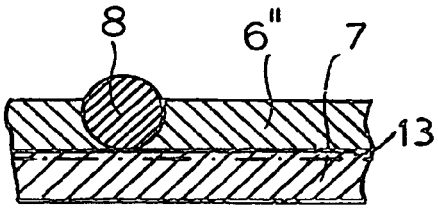
FIGS. 4 and 5 are fragmentary sections of third and fourth embodiments of initiator bridges according to the invention.

In the embodiment of FIG. 4, the reactive metal 6', e.g. nickel, is applied to the base metal 7, for example, a gold/palladium alloy and an ignition promoter 8 in the form of particulate zirconium is provided in the metal layer 6". The zirconium powder has a particle size of 1 $\mu$M.

Figure 5:
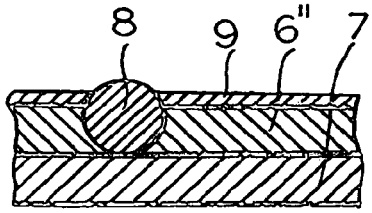

In the embodiment of FIG. 5, an anticorrosion layer is additionally applied to the reactive layer 6" containing the ignition promoter 8. The anticorrosion layer 9 is composed, for example, of gold. The anticorrosion layer can be applied by cementation.

We claim:

1. A method of making a pyrotechnic initiator comprising the steps of:

forming an electrically energizable initiator bridge of at least one first metal;

applying a second metal by electrolysis to said electrically energizable initiator bridge; and dispersing particles at least one ignition promoting metal selected from the group which consists of zirconium, hafnium, tantalum and niobium in an electrolysis solution with said second metal for deposition by said electrolysis with said second metal on said bridge.

2. The method defined in claim 1 wherein said second metal is applied to said initiator bridge in the form of a streak or spaced apart islet.

3. The method defined in claim 2 wherein said second metal and said ignition promoting metal form a reactive layer, said method further comprising applying a thin electrically insulating layer between said initiator bridge and said reactive layer.

4. The method defined in claim 3 wherein said electrically insulating layer is an oxide or nitride of said second metal.

5. The method defined in claim 4 wherein said second metal nickel.

6. The method defined in claim 1 wherein said first metal is selected from the group which consists of gold and palladium, and said second metal is nickel.

7. The method defined in claim 6, further comprising providing an ignition promotor in a region of said bridge and said second metal.

* * * * *